US008500457B2

(12) United States Patent
Sun

(10) Patent No.: US 8,500,457 B2
(45) Date of Patent: Aug. 6, 2013

(54) ATTACHMENT MECHANISM FOR ELECTRONIC COMPONENT

(75) Inventor: Zheng-Heng Sun, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/427,923

(22) Filed: Mar. 23, 2012

(65) Prior Publication Data

US 2013/0164953 A1 Jun. 27, 2013

(30) Foreign Application Priority Data

Dec. 22, 2011 (CN) ..... 2011 1 0435051

(51) Int. Cl.
*H01R 12/52* (2011.01)

(52) U.S. Cl.
USPC ..... 439/65

(58) Field of Classification Search
USPC ..... 439/65, 345, 353, 326, 272, 261, 439/493, 496, 67, 76.1, 351, 370, 372
See application file for complete search history.

(56) References Cited

U.S. PATENT DOCUMENTS

| | | | | |
|---|---|---|---|---|
| 6,089,876 | A * | 7/2000 | Kuwahara et al. | 439/67 |
| 6,201,704 | B1 * | 3/2001 | Poplawski et al. | 361/753 |
| 6,394,817 | B1 * | 5/2002 | Kihira et al. | 439/76.1 |
| 6,666,484 | B1 * | 12/2003 | Branch et al. | 292/128 |
| 6,971,899 | B1 * | 12/2005 | Liu | 439/326 |
| 7,335,032 | B1 * | 2/2008 | Lee | 439/76.1 |
| 7,554,816 | B2 * | 6/2009 | Chang | 361/759 |
| 7,753,703 | B2 * | 7/2010 | Liao et al. | 439/261 |
| 7,927,110 | B1 * | 4/2011 | Zhu | 439/67 |
| 8,287,297 | B2 * | 10/2012 | Schmidt et al. | 439/345 |

* cited by examiner

*Primary Examiner* — Alexander Gilman
(74) *Attorney, Agent, or Firm* — Altis Law Group, Inc.

(57) ABSTRACT

An attachment mechanism for fastening an electronic component includes a circuit board and a fastener. The circuit board includes a first connector to be connected to a second connector of the electronic component. The first connector defines a groove in a first end of the first connector and a hooking slot below the groove. The fastener includes a main body and an operation portion extending up from the main body. The main body includes a block engaging in the groove and a latch engaging in the hooking slot. An engaging bar protrudes from the operation portion to abut against a top of the electronic component.

12 Claims, 5 Drawing Sheets

ATTACHMENT MECHANISM FOR ELECTRONIC COMPONENT

CROSS-REFERENCE OF RELATED APPLICATION

Relevant subject matter is disclosed in a pending U.S. patent application, titled "ATTACHMENT MECHANISM FOR ELECTRONIC COMPONENT", filed on Mar. 22, 2012, with the application Ser. No. 13/426,629, which is assigned to the same assignee as this patent application.

BACKGROUND

1. Technical Field

The present disclosure relates to a mechanism for attaching an electronic component to a device.

2. Description of Related Art

An electronic component in a server, such as an expansion card, is attached to a motherboard. An end of the expansion card is fastened to the motherboard, and a connector at an opposite end of the expansion card is connected to a connector of the motherboard. However, the connection of the connectors may not be solid enough and the expansion card may disengage from the connector of the motherboard, which adversely influences the data transmission of the server.

BRIEF DESCRIPTION OF THE DRAWINGS

Many aspects of the present embodiments can be better understood with reference to the drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
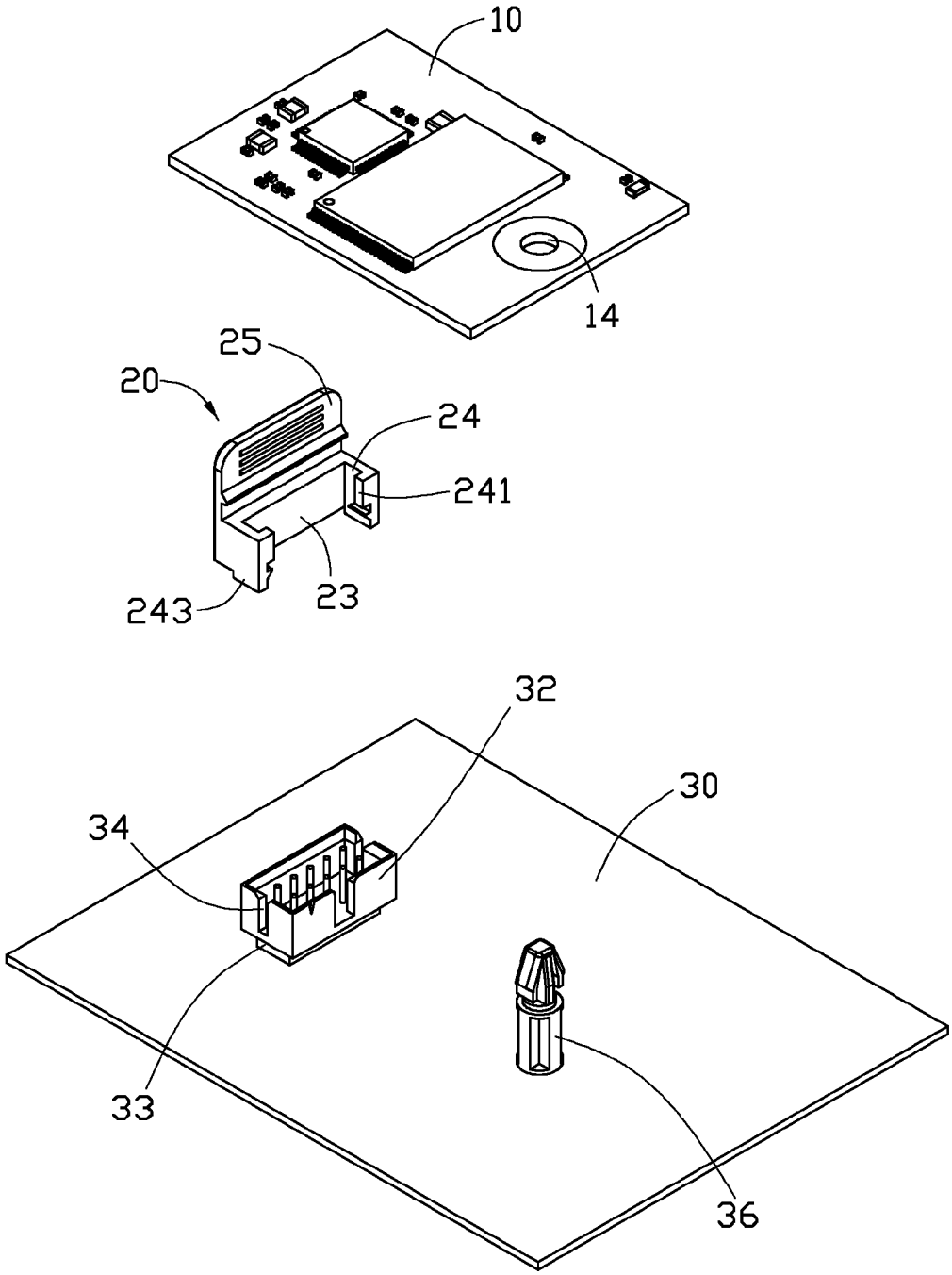
FIG. 1 is an exploded, isometric view of an exemplary embodiment of an attachment mechanism, together with an electronic component, wherein the attachment mechanism includes a fastener.
Figure 2:
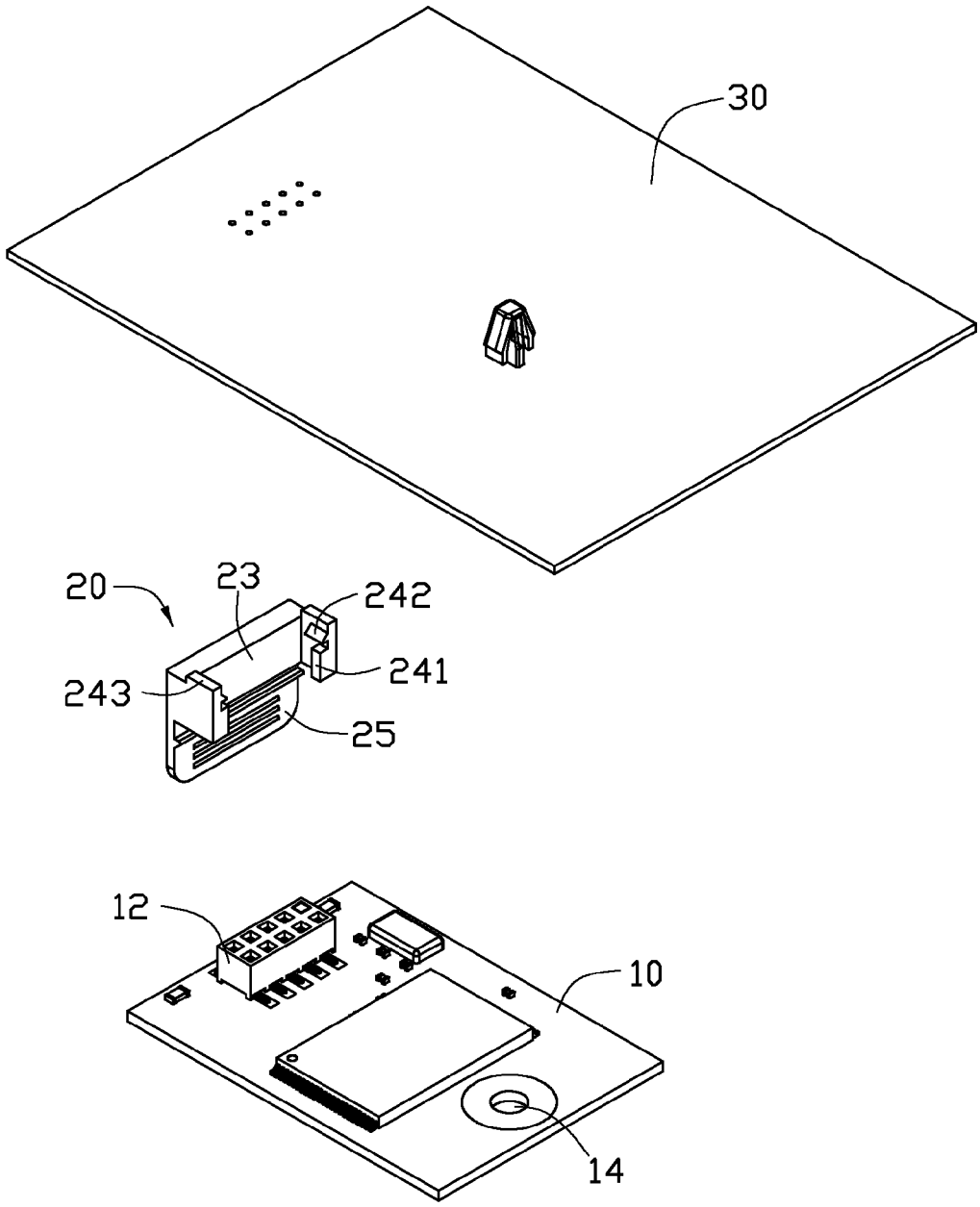
FIG. 2 is an inverted view of FIG. 1.

FIGS. 1 and 2, show an exemplary embodiment of an attachment mechanism for fastening an electronic component 10 including a circuit board 30 and a fastener 20. The electronic component 10 includes a first connector 12 mounted to a first end of a side surface, and defines a through hole 14 in a second end of the electronic component 10 opposite to the first end.

A second connector 32 is fastened to the circuit board 30. Two grooves 34 are respectively defined in upper portions of opposite ends of the second connector 32, extending through a top of the second connector 32. Two hooking slots 33 are defined between opposite ends of a bottom of the second connector 32 and the circuit board 30. A hook 36 extends up from the circuit board 30.

Figure 3:
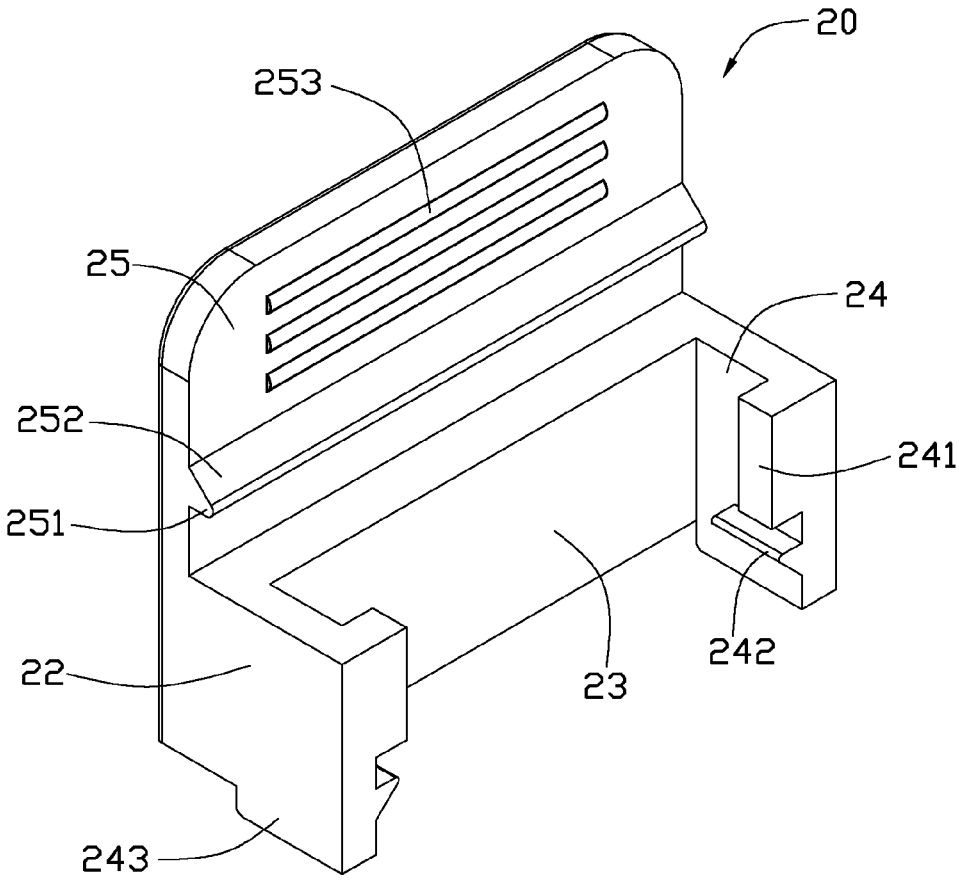
FIG. 3 is an enlarged view of the fastener of FIG. 1.

FIG. 3, shows the fastener 20 including a main body 22 and an operation portion 25. The main body 22 includes a sidewall 23 and two end walls 24 perpendicularly extending from opposite ends of the sidewall 23. A block 241 extends from an upper portion of a side of each end wall 24 away from the sidewall 23, toward the other end wall 24. A latch 242 extends from a lower portion of each end wall 24, toward the other end wall 24. An abutting portion 243 extends down from a bottom of each end wall 24. The operation portion 25 extends up from an outer side of the sidewall 23 away from the end walls 24. A long engaging bar 251 protrudes from an inner surface of the operation portion 25, above and substantially parallel to a top of the sidewall 23. A guiding surface 252 is formed on a top of the engaging bar 251, extending slantingly down. A plurality of strips 253 protrudes from the inner surface of the operation portion 25, located above the engaging bar 251, for conveniently manipulating the operation portion 25.

Figure 4:
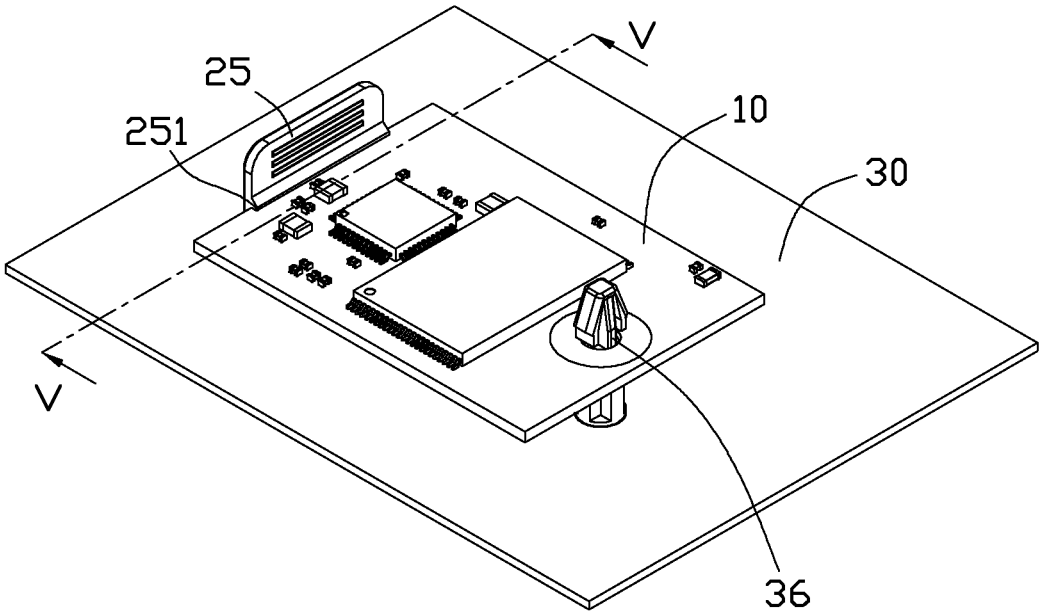
FIG. 4 is an assembled, isometric view of FIG. 1.
Figure 5:
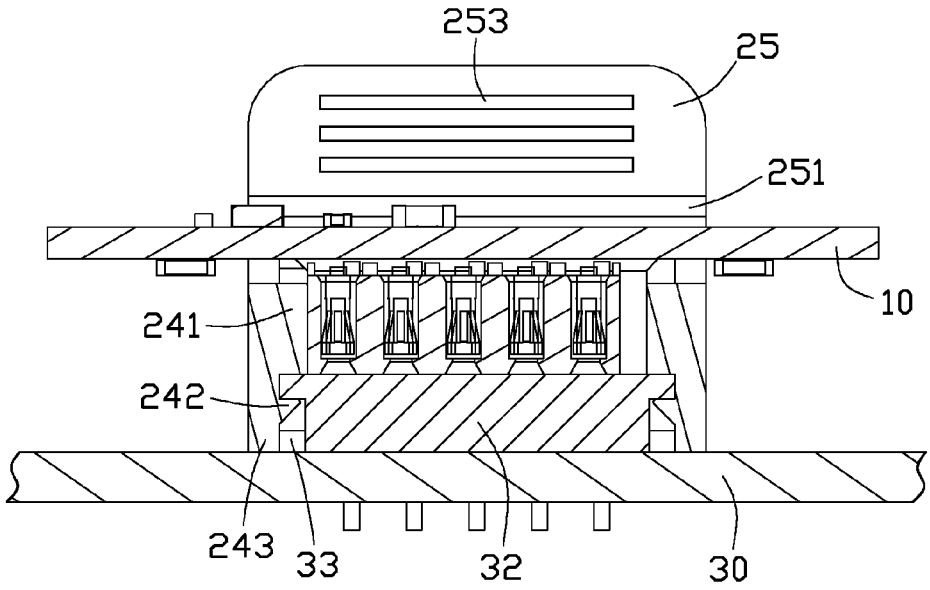
FIG. 5 is a cross-sectional view taken along the line of V-V of FIG. 4.

FIGS. 4 and 5, show in assembly, the fastener 20 is placed above the second connector 32, with the blocks 241 aligning with the corresponding grooves 34. The fastener 20 is manipulated downward, so the blocks 241 engage in the corresponding grooves 34. The sidewall 23 abuts against a corresponding side of the second connector 32, and the end walls 24 abut against the corresponding ends of the second connector 32. The second connector 32 deforms the latches 242 away from each other. When the abutting portions 243 abut against the circuit board 30, the latches 242 restore to engage in the corresponding hooking slots 33, and abut against the bottom of the second connector 32. Therefore, the attachment mechanism is assembled.

To fasten the electronic component 10, the first connector 12 is aligned above the second connector 32. The electronic component 10 is manipulated downward. The hook 36 extends through the through hole 14. When the first end of the electronic component 10 abuts against the guiding surface 252, the engaging bar 251 together with the operation portion 25 is deformed away from the electronic component 10. After the first connector 12 is connected to the second connector 32, the operation portion 25 is self-restored, to allow the engaging bar 251 to abut against the first end of a top surface of the electronic component 10. The hook 36 abuts against the second end of the top surface of the electronic component 10. Therefore, the electronic component 10 is fastened to the circuit board 30.

It is believed that the present embodiments and their advantages will be understood from the foregoing description, and various changes may be made thereto without departing from the spirit and scope of the description or sacrificing all of their materials advantages, the examples hereinbefore described merely being exemplary embodiments.

What is claimed is:

1. An attachment mechanism for fastening an electronic component, comprising:

a circuit board comprising a first connector to be connected to a second connector of the electronic component, the first connector defining a groove in a first end of the first connector and a hooking slot below the groove;

a fastener comprising a main body and an operation portion extending up from the main body, the main body comprising a block engaging in the groove and a latch engaging in the hooking slot, an engaging bar protruding from the operation portion to abut against a first end of a top of the electronic component.

2. The attachment mechanism of claim 1, wherein the main body comprises a sidewall abutting against a side of the first connector and two end walls extending from opposite ends of the sidewall for abutting against corresponding ends of the first connector, the block and the latch protrude from one of the end walls.

3. The attachment mechanism of claim 2, wherein an abutting portion extends down from a bottom of each end wall for abutting against the circuit board.

4. The attachment mechanism of claim 1, wherein a plurality of strips protrudes from the operation portion, located above the engaging bar.

5. The attachment mechanism of claim 1, wherein a guiding surface is formed on a top of the engaging bar, slantingly extending down.

6. The attachment mechanism of claim 1, wherein a hook extends up from the circuit board, to engage with a second end of the top of the electronic component.

7. A circuit board assembly, comprising:

a circuit board comprising a first connector, the first connector defining a groove in a first end and a hooking slot below the groove;

an electronic component comprising a second connector connected to the first connector; and a fastener comprising a main body and an operation portion extending up from the main body, the main body comprising a block engaging in the groove and a latch engaging in the hooking slot, an engaging bar protruding from the operation portion to abut against a top of the electronic component.

8. The circuit board assembly of claim 7, wherein the main body comprises a sidewall abutting against a side of the first connector and two end walls extending from opposite ends of the sidewall for abutting against corresponding ends of the first connector, the block and the latch protrude from one of the end walls.

9. The circuit board assembly of claim 8, wherein an abutting portion extends down from a bottom of each end wall for abutting against the circuit board.

10. The circuit board assembly of claim 7, wherein a plurality of strips protrudes from the operation portion, located above the engaging bar.

11. The circuit board assembly of claim 7, wherein a guiding surface is formed on a top of the engaging bar, slantingly extending down.

12. The circuit board assembly of claim 7, wherein a through hole is defined in the electronic component, a hook extends up from the circuit board, to extend through the through hole of the electronic component and abut against the top of the electronic component.

* * * * *